US008311843B2

(12) United States Patent
Dalimba

(10) Patent No.: US 8,311,843 B2
(45) Date of Patent: Nov. 13, 2012

(54) FREQUENCY BAND SCALE FACTOR DETERMINATION IN AUDIO ENCODING BASED UPON FREQUENCY BAND SIGNAL ENERGY

(75) Inventor: Laxminarayana M. Dalimba, Bangalore (IN)

(73) Assignee: Sling Media Pvt. Ltd., Bangalore (IN)

( * ) Notice: Subject to any disclaimer, the term of this patent is extended or adjusted under 35 U.S.C. 154(b) by 597 days.

(21) Appl. No.: 12/546,428

(22) Filed: Aug. 24, 2009

(65) Prior Publication Data

US 2011/0046966 A1 Feb. 24, 2011

(51) Int. Cl.
*G10L 21/00* (2006.01)

(52) U.S. Cl. ..... 704/503; 704/500; 704/501; 704/203; 704/205

(58) Field of Classification Search ..... 704/503, 704/500, 501, 203, 205
See application file for complete search history.

(56) References Cited

U.S. PATENT DOCUMENTS

| | | | | |
|---|---|---|---|---|
| 5,774,844 | A * | 6/1998 | Akagiri | 704/230 |
| 2003/0088400 | A1* | 5/2003 | Nishio et al. | 704/201 |
| 2003/0115050 | A1 | 6/2003 | Chen et al. | |
| 2007/0276889 | A1* | 11/2007 | Gayer et al. | 708/200 |
| 2008/0027709 | A1 | 1/2008 | Bamgarte | |
| 2008/0077413 | A1* | 3/2008 | Eguchi | 704/500 |

OTHER PUBLICATIONS

International Search Report and Written Opinion dated Jun. 8, 2011, PCT/IN2010/000557, 15 pages.

Painter et al., "Perceptual Coding of Digital Audio," Proceedings of the IEEE, New York, Apr. 1, 2000, vol. 88, No. 4, pp. 451-513.

Vary et al., "Digitale Sprachsignalverarbeitung," Jan. 1, 1998, B.G. Teubner, Stuttgart, XP002620082, Chapter 11.2.8, pp. 350-353.

Church, Steve, "On Beer and Audio Coding, Why something called AAC is cooler than a fine pilsner, and how it got to be that way", Radio World, dated Sep. 26, 2001, 12 pages.

Brandenburg, Karlheinz, "MP3 and AAC Explained", AES 17th International Conference on High Quality Audio Coding, 12 pages.

"Advanced Audio Coding", retrieved from Wikipedia internet site located at http://en.wikipedia.org/w/index.php? title=Advance_Audio_Coding&printable=yes on Jul. 28, 2009, 11 pages.

"ACC", retrieved from internet site located at http://everything2.com/title/AAC?displaytype=printable on Jul. 28, 2009, 4 pages.

"Modified Discrete Cosine Transform", retrieved from Wikipedia internet site located at http://en.wikipedia.org/w/index.php?title=Modified_discrete_cosine_transform&printable . . . on Jul. 28, 2009, 6 pages.

"How Audio Codecs Work—Psycoacoustics", retrieved from Audio DesignLine internet site located at http://www.audiodesignline.com/howto/audioprocessing/175800470 on Jul. 28, 2009, 3 pages.

* cited by examiner

*Primary Examiner* — Qi Han
(74) *Attorney, Agent, or Firm* — Ingrassia Fisher & Lorenz, P.C.

(57) ABSTRACT

A method of encoding a time-domain audio signal is presented. In the method, an electronic device receives the time-domain audio signal. The time-domain audio signal is transformed into a frequency-domain signal including a coefficient for each of a plurality of frequencies, which are grouped into frequency bands. For each frequency band, the energy of the band is determined, a scale factor for the band is determined based on the energy of the band, and the coefficients of the band are quantized based on the associated scale factor. The encoded audio signal is generated based on the quantized coefficients and the scale factors.

17 Claims, 5 Drawing Sheets

FREQUENCY BAND SCALE FACTOR DETERMINATION IN AUDIO ENCODING BASED UPON FREQUENCY BAND SIGNAL ENERGY

BACKGROUND

Efficient compression of audio information reduces both the memory capacity requirements for storing the audio information, and the communication bandwidth needed for transmission of the information. To enable this compression, various audio encoding schemes, such as the ubiquitous Motion Picture Experts Group 1 (MPEG-1) Audio Layer 3 (MP3) format and the newer Advanced Audio Coding (AAC) standard, employ at least one psychoacoustic model (PAM), which essentially describes the limitations of the human ear in receiving and processing audio information. For example, the human audio system exhibits an acoustic masking principle in both the frequency domain (in which audio at a particular frequency masks audio at nearby frequencies below certain volume levels) and the time domain (in which an audio tone of a particular frequency masks that same tone for some time period after removal). Audio encoding schemes providing compression take advantage of these acoustic masking principles by removing those portions of the original audio information that would be masked by the human audio system.

To determine which portions of the original audio signal to remove, the audio encoding system typically processes the original signal to generate a masking threshold, so that audio signals lying beneath that threshold may be eliminated without a noticeable loss of audio fidelity. Such processing is quite computationally-intensive, making real-time encoding of audio signals difficult. Further, performing such computations is typically laborious and time-consuming for consumer electronics devices, many of which employ fixed-point digital signal processors (DSPs) not specifically designed for such intense processing.

BRIEF DESCRIPTION OF THE DRAWINGS

Many aspects of the present disclosure may be better understood with reference to the following drawings. The components in the drawings are not necessarily depicted to scale, as emphasis is instead placed upon clear illustration of the principles of the disclosure. Moreover, in the drawings, like reference numerals designate corresponding parts throughout the several views. Also, while several embodiments are described in connection with these drawings, the disclosure is not limited to the embodiments disclosed herein. On the contrary, the intent is to cover all alternatives, modifications, and equivalents.

DETAILED DESCRIPTION

The enclosed drawings and the following description depict specific embodiments of the invention to teach those skilled in the art how to make and use the best mode of the invention. For the purpose of teaching inventive principles, some conventional aspects have been simplified or omitted. Those skilled in the art will appreciate variations of these embodiments that fall within the scope of the invention. Those skilled in the art will also appreciate that the features described below can be combined in various ways to form multiple embodiments of the invention. As a result, the invention is not limited to the specific embodiments described below, but only by the claims and their equivalents.

Figure 1:
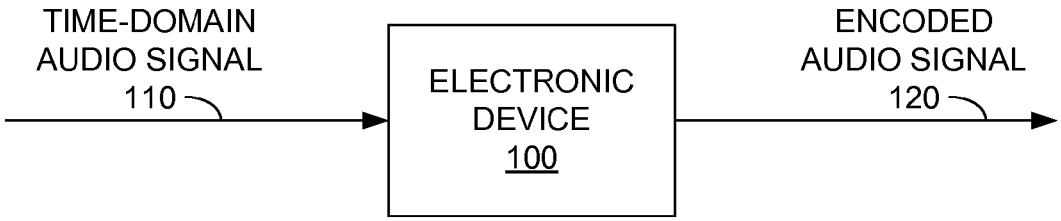
FIG. 1 is a simplified block diagram of an electronic device configured to encode a time-domain audio signal according to an embodiment of the invention.

FIG. 1 provides a simplified block diagram of an electronic device 100 configured to encode a time-domain audio signal 110 as an encoded audio signal 120 according to an embodiment of the invention. In one implementation, the encoding is performed according to the Advanced Audio Coding (AAC) standards, although other encoding schemes involving the transformation of a time-domain signal into an encoded audio signal may utilize the concepts discussed below to advantage. Further, the electronic device 100 may be any device capable of performing such encoding, including, but not limited to, personal desktop and laptop computers, audio/video encoding systems, compact disc (CD) and digital video disk (DVD) players, television set-top boxes, audio receivers, cellular phones, personal digital assistants (PDAs), and audio/video place-shifting devices, such as the various models of the Slingbox® provided by Sling Media, Inc.

Figure 2:
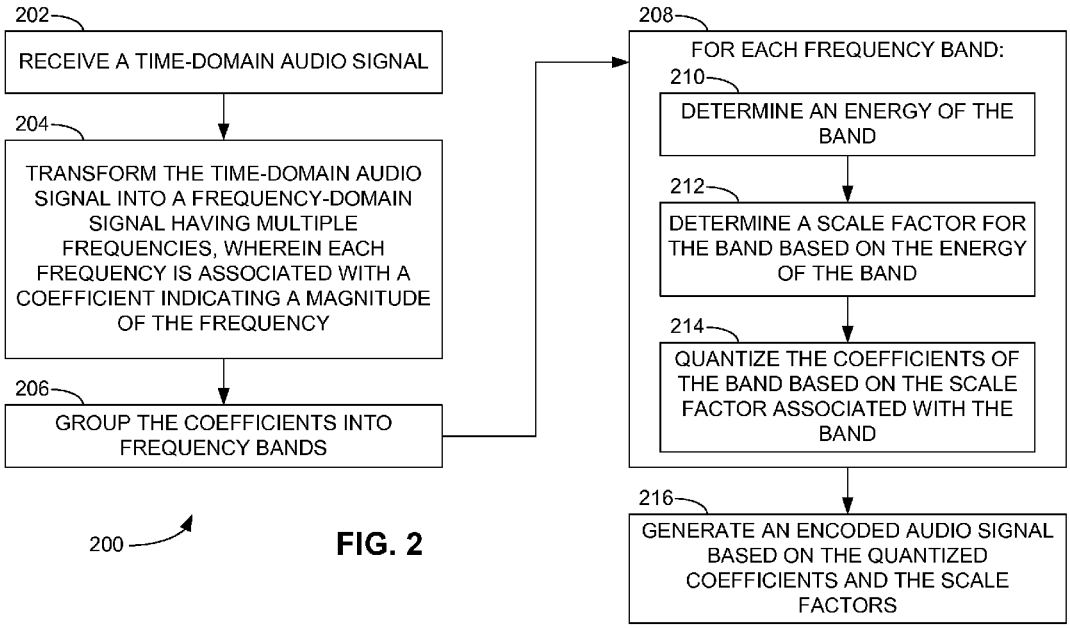
FIG. 2 is a flow diagram of a method of operating the electronic device of FIG. 1 to encode a time-domain audio signal according to an embodiment of the invention.

FIG. 2 presents a flow diagram of a method 200 of operating the electronic device 100 of FIG. 1 to encode the time-domain audio signal 110 to yield the encoded audio signal 120. In the method 200, the electronic device 100 receives the time-domain audio signal 110 (operation 202). The device 100 then transforms the time-domain audio signal 110 into a frequency-domain signal having a plurality of frequencies, with each frequency being associated with a coefficient indicating a magnitude of that frequency (operation 204). The coefficients are then grouped into frequency bands (operation 206). Each of the frequency bands includes at least one of the coefficients. For each frequency band (operation 208), the electronic device 100 determines an energy of the frequency band (operation 210), determines a scale factor for the band based on the energy of the frequency band (operation 212), and quantizes the coefficients of the frequency band based on the scale factor associated with that band (operation 214). The device 100 generates the encoded audio signal 120 based on the quantized coefficients and the scale factors (operation 216).

While the operations of FIG. 2 are depicted as being executed in a particular order, other orders of execution, including concurrent execution of two or more operations, may be possible. For example, the operations of FIG. 2 may be executed as a type of execution pipeline, wherein each operation is performed on a different portion of the time-domain audio signal 110 as it enters the pipeline. In another embodiment, a computer-readable storage medium may have encoded thereon instructions for at least one processor or other control circuitry of the electronic device 100 of FIG. 1 to implement the method 200.

As a result of at least some embodiments of the method 200, the scale factor utilized for each frequency band to quantize the coefficients of that band are based on a determination of the energy of the frequencies of the band. Such a determination is typically much less computationally-intensive than a calculation of a masking threshold, as is typically performed in most AAC implementations. As a result, real-time audio encoding by any class of electronic device, including small devices utilizing inexpensive digital signal processing components, may be possible. Other advantages may be recognized from the various implementations of the invention discussed in greater detail below.

Figure 3:
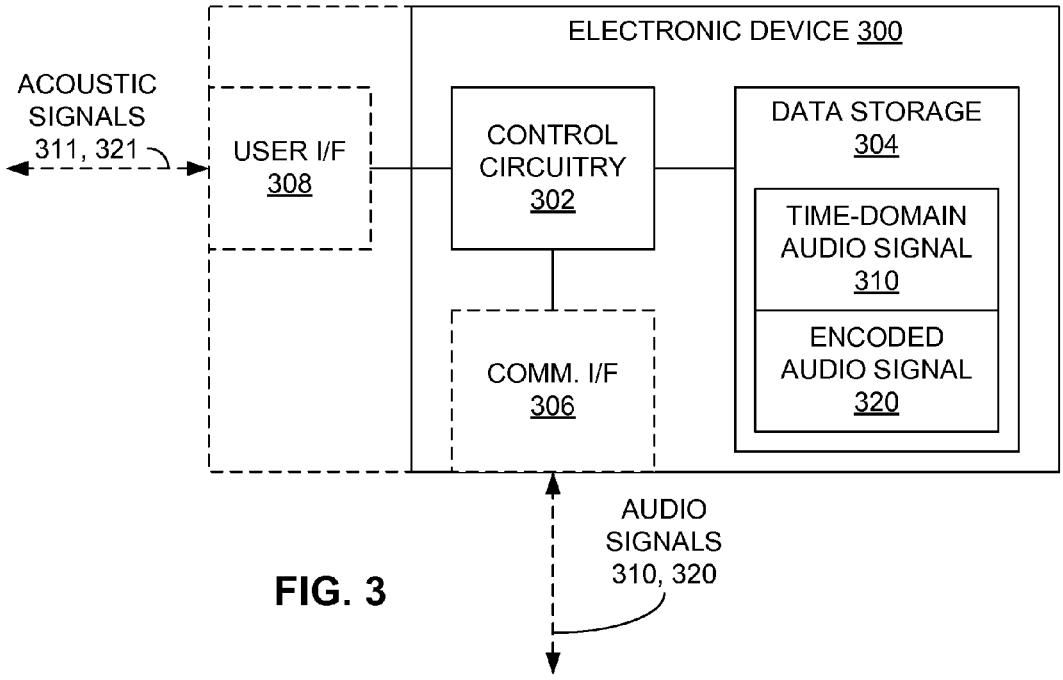
FIG. 3 is a block diagram of an electronic device according to another embodiment of the invention.

FIG. 3 is a block diagram of an electronic device 300 according to another embodiment of the invention. The device 300 includes control circuitry 302 and data storage 304. In some implementations, the device 300 may also include either or both of a communication interface 306 and a user interface 308. Other components, including, but not limited to, a power supply and a device enclosure, may also be included in the electronic device 300, but such components are not explicitly shown in FIG. 3 nor discussed below to simplify the following discussion.

The control circuitry 302 is configured to control various aspects of the electronic device 300 to encode a time-domain audio signal 310 as an encoded audio signal 320. In one embodiment, the control circuitry 302 includes at least one processor, such as a microprocessor, microcontroller, or digital signal processor (DSP), configured to execute instructions directing the processor to perform the various operations discussed in greater detail below. In another example, the control circuitry 302 may include one or more hardware components configured to perform one or more of the tasks or operations described hereinafter, or incorporate some combination of hardware and software processing elements.

The data storage 304 is configured to store some or all of the time-domain audio signal 310 to be encoded and the resulting encoded audio signal 320. The data storage 304 may also store intermediate data, control information, and the like involved in the encoding process. The data storage 304 may also include instructions to be executed by a processor of the control circuitry 302, as well as any program data or control information concerning the execution of the instructions. The data storage 304 may include any volatile memory components (such as dynamic random-access memory (DRAM) and static random-access memory (SRAM)), nonvolatile memory devices (such as flash memory, magnetic disk drives, and optical disk drives, both removable and captive), and combinations thereof.

The electronic device 300 may also include a communication interface 306 configured to receive the time-domain audio signal 310, and/or transmit the encoded audio signal 320 over a communication link. Examples of the communication interface 306 may be a wide-area network (WAN) interface, such as a digital subscriber line (DSL) or cable interface to the Internet, a local-area network (LAN), such as Wi-Fi or Ethernet, or any other communication interface adapted to communicate over a communication link or connection in a wired, wireless, or optical fashion.

In other examples, the communication interface 306 may be configured to send the audio signals 310, 320 as part of audio/video programming to an output device (not shown in FIG. 3), such as a television, video monitor, or audio/video receiver. For example, the video portion of the audio/video programming may be delivered by way of a modulated video cable connection, a composite or component video RCA-style (Radio Corporation of America) connection, and a Digital Video Interface (DVI) or High-Definition Multimedia Interface (HDMI) connection. The audio portion of the programming may be transported over a monaural or stereo audio RCA-style connection, a TOSLINK connection, or over an HDMI connection. Other audio/video formats and related connections may be employed in other embodiments.

Further, the electronic device 300 may include a user interface 308 configured to receive acoustic signals 311 represented by the time-domain audio signal 310 from one or more users, such as by way of an audio microphone and related circuitry, including an amplifier, an analog-to-digital converter (ADC), and the like. Likewise, the user interface 308 may include amplifier circuitry and one or more audio speakers to present to the user acoustic signals 321 represented by the encoded audio signal 320. Depending on the implementation, the user interface 308 may also include means for allowing a user to control the electronic device 300, such as by way of a keyboard, keypad, touchpad, mouse, joystick, or other user input device. Similarly, the user interface 308 may provide a visual output means, such as a monitor or other visual display device, allowing the user to receive visual information from the electronic device 300.

Figure 4:
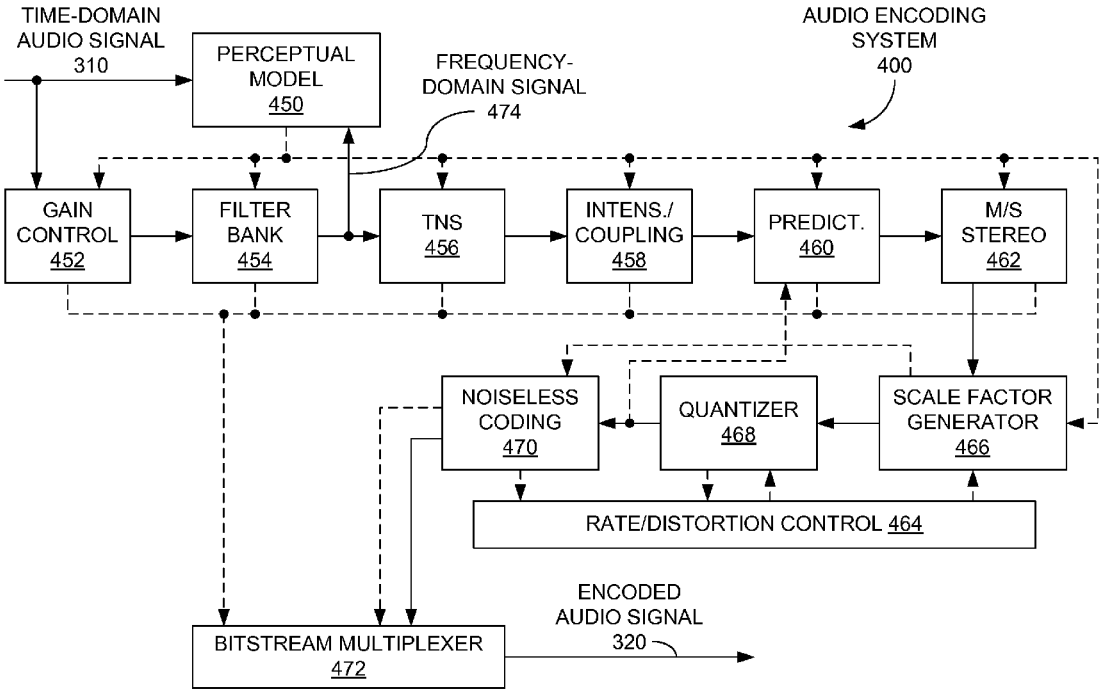
FIG. 4 is a block diagram of an audio encoding system according to an embodiment of the invention.

FIG. 4 provides an example of an audio encoding system 400 provided by the electronic device 300 to encode the time-domain audio signal 310 as the encoded audio signal 320 of FIG. 3. The control circuitry 302 of FIG. 3 may implement each portion of the audio encoding system 400 by way of hardware circuitry, a processor executing software or firmware instructions, or some combination thereof.

The specific system 400 of FIG. 4 represents a particular implementation of AAC, although other audio encoding schemes may be utilized in other embodiments. Generally, AAC represents a modular approach to audio encoding, whereby each functional block 450-472 of FIG. 4, as well as those not specifically depicted therein, may be implemented in a separate hardware, software, or firmware module or "tool", thus allowing modules originating from varying development sources to be integrated into a single encoding system 400 to perform the desired audio encoding. As a result, the use of different numbers and types of modules may result in the formation of any number of encoder "profiles", each capable of addressing specific constraints associated with a particular encoding environment. Such constraints may include the computational capability of the device 300, the complexity of the time-domain audio signal 310, and the desired characteristics of the encoded audio signal 320, such as the output bit rate and distortion level. The AAC standard typically offers four default profiles, including the low-complexity (LC) profile, the main (MAIN) profile, the sample-rate scalable (SRS) profile, and the long-term prediction (LTP) profile. The system 400 of FIG. 4 corresponds primarily with the main profile, although other profiles may incorporate the enhancements to the perceptual model 450, the scale factor generator 466, and/or the rate/distortion control block 464 described hereinafter.

FIG. 4 depicts the general flow of the audio data by way of solid arrowed lines, while some of the possible control paths are illustrated via dashed arrowed lines. Other possibilities regarding the passing of control information among the modules 450-472 not specifically shown in FIG. 4 may be possible in other arrangements.

In FIG. 4, the time-domain audio signal 310 is received as an input to the system 400. Generally, the time-domain audio signal 310 includes one or channels of audio information formatted as a series of digital samples of a time-varying audio signal. In some embodiments, the time-domain audio signal 310 may originally take the form of an analog audio signal that is subsequently digitized at a prescribed rate, such as by way of an ADC of the user interface 308, before being forwarded to the encoding system 400, as implemented by the control circuitry 302.

As illustrated in FIG. 4, the modules of the audio encoding system 400 may include a gain control block 452, a filter bank 454, a temporal noise shaping (TNS) block 456, an intensity/coupling block 458, a backward prediction tool 460, and a mid/side stereo block 462, configured as part of a processing pipeline that receives the time-domain audio signal 310 as input. These function blocks 452-462 may correspond to the same functional blocks often seen in other implementations of AAC. The time-domain audio signal 310 is also forwarded to a perceptual model 450, which may provide control information to any of the function blocks 452-462 mentioned above. In a typical AAC system, this control information indicates which portions of the time-domain audio signal 310 are superfluous under a psychoacoustic model (PAM), thus allowing those portions of the audio information in the time-domain audio signal 310 to be discarded to facilitate compression as realized in the encoded audio signal 320.

To this end, in typical AAC systems, the perceptual model 450 calculates a masking threshold from an output of a Fast Fourier Transform (FFT) of the time-domain audio signal 310 to indicate which portions of the audio signal 310 may be discarded. In the example of FIG. 4, however, the perceptual model 450 receives the output of the filter bank 454, which provides a frequency-domain signal 474. In one particular example, the filter bank 454 is a modified discrete cosine transform (MDCT) function block, as is normally provided in AAC systems.

Figure 5:
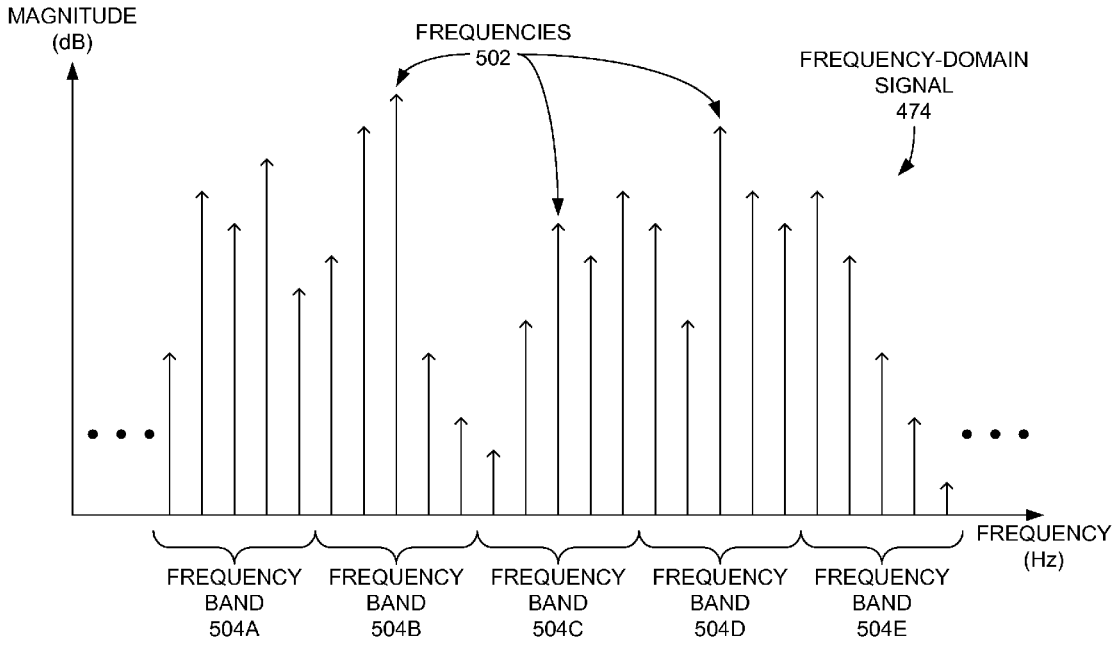
FIG. 5 is a graphical depiction of a frequency-domain signal possessing frequency bands according to an embodiment of the invention.

As depicted in FIG. 5, the frequency-domain signal 474 produced by the MDCT block 454 includes a number of frequencies 502 for each channel of audio information to be encoded, with each frequency 502 being represented by a coefficient indicating the magnitude or intensity of that frequency 502 in the frequency-domain signal 474. In FIG. 5, each frequency 502 is depicted as a vertical vector whose height represents the value of the coefficient associated with that frequency 502.

Additionally, the frequencies 502 are logically organized into contiguous frequency groups or "bands" 504A-504E, as is done in typical AAC schemes. While FIG. 4 indicates that each frequency band 504 utilizes the same range of frequencies, and includes the same number of discrete frequencies 502 produced by the filter bank 454, varying numbers of frequencies 502 and sizes of frequency 502 ranges may be employed among the bands 504, as is often the case is AAC systems.

The frequency bands 504 are formed to allow the coefficient of each frequency 502 of a band 504 of frequencies 502 to be scaled or divided by way of a scale factor generated by the scale factor generator 466 of FIG. 4. Such scaling reduces the amount of data representing the frequency 502 coefficients in the encoded audio signal 320, thus compressing the data, resulting in a lower transmission bit rate for the encoded audio signal 320. This scaling also results in quantization of the audio information, wherein the frequency 502 coefficients are forced into discrete predetermined values, thus possibly introducing some distortion in the encoded audio signal 320 after decoding. Generally speaking, higher scaling factors cause coarser quantization, resulting in higher audio distortion levels and lower encoded audio signal 320 bit rates.

To meet predetermined distortion levels and bit rates for the encoded audio signal 320 in previous AAC systems, the perceptual model 450 calculates the masking threshold mentioned above to determine an acceptable scale factor for each sample block of the encoded audio signal 320. However, in the embodiments discussed herein, the perceptual model 450 instead determines the energy associated with the frequencies 502 of each frequency band 504, and then calculates a desired scale factor for each band 504 based on that energy. In one example, the energy of the frequencies 502 in a frequency band 504 is calculated by the "absolute sum", or the sum of the absolute value, of the MDCT coefficients of the frequencies 502 in the band 504, sometimes referred to as the sum of absolute spectral coefficients (SASC).

Once the energy for the band 504 is determined, the scale factor associated with the band 504 may be calculated by taking a logarithm, such as a base-ten logarithm, of the energy of the band 504, adding a constant value, and then multiplying that term by a predetermined multiplier to yield at least an initial scale factor for the band 504. Experimentation in audio encoding according to previously known psychoacoustic models indicates that a constant of approximately 1.75 and a multiplier of 10 yield scale factors comparable to those generated as a result of extensive masking threshold calculations. Thus, for this particular example, the following equation for a scale factor is produced.

$$\text{scale_factor}=(\log_{10}(\Sigma|\text{band_coefficients}|)+1.75)*10$$

Other values for the constant other than 1.75 may be employed in other configurations.

To encode the time-domain audio signal 310, the MDCT filter bank 454 produces a series of blocks of frequency samples for the frequency-domain signal 474, with each block being associated with a particular time period of the time-domain audio signal 310. Thus, the scale factor calculations noted above may be undertaken for every block of each channel of frequency samples produced in the frequency-domain signal 474, thus potentially providing a different scale factor for each block of each frequency band 504. Given the amount of data involved, the use of the above calculation for each scale factor significantly reduces the amount of processing required to determine the scale factors compared to estimating a masking threshold for the same blocks of frequency samples.

A quantizer 468 following the scale factor generator 466 in the pipeline employs the scale factor for each frequency band 504, as generated by the scale factor generator 466 (and possibly adjusted by a rate/distortion control block 464, as described below), to divide the coefficients of the various frequencies 502 in that band 504. By dividing the coefficients, the coefficients are reduced or compressed in size, thus lowering the overall bit rate of the encoded audio signal 320. Such division results in the coefficients being quantized into one of some defined number of discrete values.

In one embodiment, the use of the equation cited above to generate the scale factors may be limited to those circumstances in which the target or desired bit rate of the encoded audio signal 320 does not exceed some predetermined level or value. To address those scenarios in which the target bit rate exceeds the predetermined level, the rate/distortion control block 464 may instead determine which of the coefficients of each frequency band 504 is the highest or maximum coefficient for that band 504, and then select a scale factor for the band 504 such that the quantized value of that coefficient, as generated by the quantizer 468, is not forced to zero. By generating scale factors in such a manner, the presence of audio "holes", in which an entire band 504 of frequencies is missing from the encoded audio signal 320 for periods of time, and thus may be noticeable to the listener, may be avoided. In one embodiment, the rate/distortion control block 464 may select the largest scale factor that allows the maximum coefficient of the band 504 to be nonzero after quantization.

After quantization, a noiseless coding block 470 codes the resulting quantized coefficients according to a noiseless coding scheme. In one embodiment, the coding scheme may be the lossless Huffman coding scheme employed in AAC.

The rate/distortion control block 464, as depicted in FIG. 4, may adjust one or more of the scale factors being generated in the scale factor generator 466 to meet predetermined bit rate and distortion level requirements for the encoded audio signal 320. For example, the rate/distortion control block 464 may determine that the calculated scale factor may result in an output bit rate for the encoded audio signal 320 that is significantly high compared to the average bit rate to be attained, and thus increase the scale factor accordingly.

In another implementation, the rate/distortion control module 464 employs a bit reservoir, or "leaky bucket", model to adjust the scale factors to maintain an acceptable average bit rate of the encoded audio signal 320 while allowing the bit rate to increase from time to time to accommodate periods of the time-domain audio signal 310 that include higher data content. More specifically, an actual or virtual bit reservoir or buffer with a capacity of some period of time associated with the required bit rate of the encoded audio signal 320 is presumed to be initially empty. In one example, the size of the buffer corresponds to approximately five seconds of data for the encoded audio signal 320, although shorter or longer periods of time may be invoked in other implementations.

During ideal data transfer conditions in which the scale factors produced by the scale factor generator 466 cause the actual bit rate of the output audio signal 320 to match the desired bit rate, the buffer remains in its initially empty state. However, if a section of multiple blocks of the encoded audio signal 320 temporarily demands the use of a higher bit rate to maintain a desired distortion level, the higher bit rate may be applied, thus consuming some of the buffer or reservoir. If the fullness of the buffer then exceeds some predetermined threshold, the scale factors being generated may be increased to reduce the output bit rate. Similarly, if the output bit rate falls so that the buffer remains empty, the rate/distortion control block 464 may reduce the scale factors being supplied by the scale factor generator 466 to increase the bit rate. Depending on the embodiment, the rate/distortion control block 464 may increase or reduce the scale factors of all of the frequency bands 504, or may select particular scale factors for adjustment, depending on the original scale factors, the coefficients, and other characteristics.

In one arrangement, the ability of the rate/distortion control block 464 to adjust the scale factors on the basis of the bit rate being produced may be employed prior to application of the bit reservoir model described above to allow the model to converge quickly to scale factors that both adhere to the predetermined bit rate while injecting the least amount of distortion into the encoded audio signal 320.

After the scale factors and coefficients are encoded in the coding block 470, the resulting data are forwarded to a bitstream multiplexer 472, which outputs the encoded audio signal 320, which includes the coefficients and scale factors. This data may be further intermixed with other control information and metadata, such as textual data (including a title and related information related to the encoded audio signal 320), and information regarding the particular encoding scheme being used so that a decoder receiving the audio signal 320 may decode the signal 320 accurately.

At least some embodiments as described herein provide a method of audio encoding in which the energy exhibited by audio frequencies within each frequency band of an audio signal may be employed to calculate useful scale factors for the encoding and compression of the audio information with relatively little computation. By generating the scale factors in such a manner, real-time encoding of audio signals, such as may be undertaken in a place-shifting device to transmit audio over a communication network, may be easier to accomplish. Further, generating scale factors in such a manner may allow many portable and other consumer devices possessing inexpensive digital signal processing circuitry that were previously unable to encode and compress audio signals to provide such capability.

While several embodiments of the invention have been discussed herein, other implementations encompassed by the scope of the invention are possible. For example, while at least one embodiment disclosed herein has been described within the context of a place-shifting device, other digital processing devices, such as general-purpose computing systems, television receivers or set-top boxes (including those associated with satellite, cable, and terrestrial television signal transmission), satellite and terrestrial audio receivers, gaming consoles, DVRs, and CD and DVD players, may benefit from application of the concepts explicated above. In addition, aspects of one embodiment disclosed herein may be combined with those of alternative embodiments to create further implementations of the present invention. Thus, while the present invention has been described in the context of specific embodiments, such descriptions are provided for illustration and not limitation. Accordingly, the proper scope of the present invention is delimited only by the following claims and their equivalents.

What is claimed is:

1. A method of encoding a time-domain audio signal, the method comprising:

at an electronic device, receiving the time-domain audio signal;

transforming the time-domain audio signal into a frequency-domain signal comprising a coefficient for each of a plurality of frequencies;

grouping the coefficients into frequency bands, wherein each of the frequency bands includes at least one of the coefficients;

for each frequency band, determining an energy of the frequency band; for each frequency band, determining a scale factor based on the energy of the frequency band, wherein determining the scale factor includes calculating a base-ten logarithm of the energy of the frequency band, adding a constant to the base-ten logarithm of the energy of the frequency band to yield a first term, and multiplying the first term by a multiplier to yield the scale factor;

for each frequency band, quantizing the coefficients of the frequency band based on the associated scale factor; and generating an encoded audio signal based on the quantized coefficients and the scale factors.

2. The method of claim 1, wherein:

generating the encoded signal comprises encoding the quantized coefficients, wherein the encoded audio signal is based on the encoded coefficients and the scale factors.

3. The method of claim 1, wherein determining the energy of the frequency band comprises:

calculating an absolute sum of the coefficients of the frequency band.

4. The method of claim 1, wherein:

the constant is approximately 1.75; and the multiplier is 10.

5. The method of claim 1, wherein:

determining the energy of the frequency band and determining the scale factor based on the energy of the frequency band is performed when a target bit rate of the encoded audio signal does not exceed a predetermined level; and the method further comprises:

when the target bit rate of the encoded audio signal exceeds a predetermined level, for each of the frequency bands, determining a maximum coefficient of the coefficients of the frequency band, and selecting a scale factor such that the quantized coefficient associated with the maximum coefficient is not zero.

6. The method of claim 1, further comprising:

for each frequency band, adjusting the scale factor based on a predetermined bit rate for the encoded audio signal, wherein the scale factor is inversely related to the predetermined bit rate.

7. The method of claim 1, further comprising:

for each frequency band, adjusting the scale factor based on a bit reservoir model for maintaining a predetermined bit rate for the encoded audio signal.

8. The method of claim 7, wherein:

the bit reservoir model corresponds to five seconds of the encoded audio signal at the predetermined bit rate.

9. A method of generating a scale factor for frequency coefficients of a frequency band of a frequency-domain audio signal for producing a quantized output signal, the method comprising:

for a bit rate for the quantized output signal not exceeding a predetermined level, determining an energy of the frequency band at an electronic device, and determining a scale factor based on the energy of the frequency band of the audio signal, wherein determining the scale factor includes calculating a logarithm of the energy of the frequency band, adding a constant to the logarithm of the energy of the frequency band to yield a first term, and multiplying the first term by a multiplier to yield the scale factor; and for a bit rate for the quantized output signal exceeding the predetermined level, determining a maximum frequency coefficient of the frequency band, and selecting a scale factor such that the corresponding coefficient after quantization is not zero;

wherein quantization of the frequency coefficients is based on the scale factor.

10. The method of claim 9, wherein determining the energy of the frequency band comprises:

calculating an absolute sum of the coefficients of the frequency band.

11. The method of claim 9, wherein:

the constant is approximately 1.75; and the multiplier is 10.

12. The method of claim 9, further comprising:

for each frequency band, adjusting the scale factor based on the bit rate for the quantized output signal, wherein the scale factor is inversely related to the bit rate for the quantized output signal.

13. An electronic device, comprising:

data storage configured to store a time-domain audio signal and an encoded audio signal representing the time-domain audio signal; and control circuitry configured to:

retrieve the time-domain audio signal from the data storage;

transform the time-domain audio signal into a frequency-domain signal comprising a coefficient for each of a plurality of frequencies;

group the coefficients into frequency bands, wherein each of the frequency bands includes at least one of the coefficients;

for each frequency band, determine an energy of the frequency band;

for each frequency band, determine a scale factor based on the energy of the frequency band, wherein determining the scale factor includes determining a logarithm of the energy of the frequency band, adding a constant to the logarithm of the energy of the frequency band to yield a first term, and multiplying the first term by a multiplier to generate the scale factor;

for each frequency band, quantize the coefficients of the frequency band based on the associated scale factor; and generate the encoded audio signal based on the quantized coefficients and the scale factors.

14. The electronic device of claim 13, wherein the control circuitry is configured to:

store the encoded audio signal in the data storage.

15. The electronic device of claim 13, wherein, to determine the energy of the frequency band, the control circuitry is configured to:

sum the absolute value of the coefficients of the frequency band.

16. The electronic device of claim 13, wherein:

the constant is approximately 1.75; and the multiplier is 10.

17. The electronic device of claim 13, wherein:

the control circuitry is configured to determine the energy of the frequency band and determine the scale factor based on the energy of the frequency band when a target bit rate of the encoded audio signal does not exceed a predetermined level; and when the target bit rate of the encoded audio signal exceeds the predetermined level, the control circuitry is configured to determine a maximum frequency coefficient of the frequency band, and select a scale factor such that the corresponding coefficient after quantization is nonzero.

* * * * *